US006098854A

United States Patent [19]

Apple

[11] Patent Number: 6,098,854

[45] Date of Patent: Aug. 8, 2000

[54] FINGER TIP PROTECTIVE DEVICE FOR SEWING AND QUILTING

[76] Inventor: Judy A. Apple, 2945 Clark Rd., Suite 104, Ypsilanti, Mich. 48197

[21] Appl. No.: 09/062,478

[22] Filed: Apr. 17, 1998

Related U.S. Application Data

[60] Provisional application No. 60/044,236, Apr. 24, 1997.

[51] Int. Cl.[7] ..... D05B 91/04

[52] U.S. Cl. ..... 223/101; 2/21

[58] Field of Search ..... 223/101, 1; 2/21

[56] References Cited

U.S. PATENT DOCUMENTS

| | | | |
|---|---|---|---|
| 1,135,382 | 4/1915 | Kindred | 2/21 |
| 2,610,776 | 9/1952 | Smith | 223/101 |
| 2,847,005 | 8/1958 | Bourne | 2/21 |
| 3,191,824 | 6/1965 | Burr | 2/21 |
| 4,239,134 | 12/1980 | Joy | 223/101 |
| 5,172,424 | 12/1992 | Adkins | 2/21 |
| 5,765,731 | 6/1998 | Callian | 223/101 |

*Primary Examiner*—Bibhu Mohanty
*Attorney, Agent, or Firm*—James M. Deimen

[57] ABSTRACT

A new sewing and quilting finger tip protective device comprises a thin metal or hard plastic disc formed into a portion of a spherical shell. A double-sided adhesive pad is removably adhered to the concave surface of the shell whereby upon application of the concave surface and pad to a finger tip, the hard shell protects against needle penetration of the skin. The shell is sized to effectively cover that portion of the finger tip most likely to be pricked by a needle when quilting. Because the shell's shape effectively conforms to the finger tip portion to be protected, the shell acts as a hard skin without substantially increasing the size of user's finger tip.

10 Claims, 1 Drawing Sheet

FINGER TIP PROTECTIVE DEVICE FOR SEWING AND QUILTING

This application is a complete application based on provisional patent application No. 60/044,236, filed Apr. 24, 1997.

BACKGROUND OF THE INVENTION

The field of the invention pertains to finger tip protective devices and, in particular, to devices to protect against pricks and stabs with sewing needles during quilting and other similar crafts.

In hand sewing quilts one hand, usually the thumb and index finger, grasps the needle and the other hand is positioned under the fabric hidden from view. The fabric must be fully supported at the location where sewing is occurring, and this support is normally provided by the index finger or middle finger under the fabric. The soft underportion of the finger tip becomes a frequent target for the needle tip. A common thimble is typically used to protect the finger tip, however, for very fine and exacting quilting the thimble is too large and awkward. In addition, with lengthy periods of quilting, the thimble becomes warm and uncomfortable.

U.S. Pat. No. 4,460,113 discloses a needle work tool and finger protector of generally V-shape with flat surfaces. This protector covers both the fingernail and the soft flesh of the finger tip. U.S. Pat. No. 4,616,770 discloses a quilting tool of generally spoon shape. The spoon portion covers the soft flesh of the finger tip and extends beyond the tip of the fingernail. U.S. Pat. No. 5,172,424 discloses a flexible strip that attaches adhesively to the soft flesh of the finger tip.

SUMMARY OF THE INVENTION

The new finger tip protective device comprises a thin metal disc formed into a portion of a spherical shell. A double-sided adhesive pad is removably adhered to the concave surface of the shell whereby upon application of the concave surface and pad to a finger tip, the metal shell protects against needle penetration of the skin. The shell is sized to effectively cover that portion of the finger tip most likely to be pricked by a needle when quilting and because of the shell's shape the shell effectively conforms to the finger tip thereby acting as a hard metal skin without substantially increasing the size of the user's finger tip.

Although described above as a portion of a spherical shell, other concave shapes and other hard plastic materials may be employed to cover the portion of a finger tip desired for the particular sewing application. In this manner, the protective device provides protection without substantially increasing the size or changing the shape of the finger tip. Moreover, the finger tip is less likely to become warm and uncomfortable with lengthy use.

DESCRIPTION OF THE PREFERRED EMBODIMENT

Figure 1:
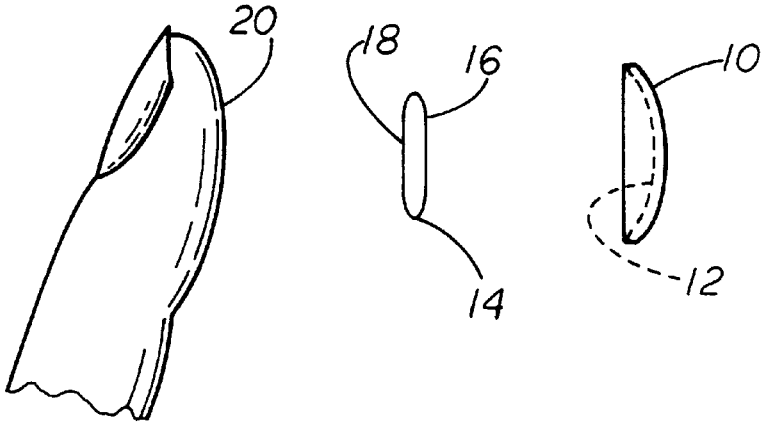
FIG. 1 illustrates in exploded side view a finger tip and the device.

Illustrated in FIG. 1, the finger tip protective device comprises a metal disc like shell 10 of concave 12 configuration and a double-sided adhesive pad 14. The adhesive on one side 16 of the pad 14 removably adheres to the concave surface 12 of the metal shell 10 and the other side 18 removably adheres to a finger tip 20. When the adhesive on the pad eventually becomes contaminated with debris from use, the pad 14 may be removed and replaced with a fresh identical pad. The pads 14 are preferably made from open weave cotton material with the adhesive rolled onto both sides of the material. The pads 14 are then punched out in the shape of discs slightly smaller than the diameter of the metal shell 10 so as to fit within the shell.

Figure 2:
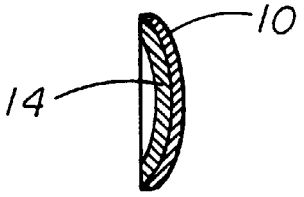
FIG. 2 illustrates the device in side cross-sectional view.

FIG. 2 illustrates the configuration of the device with the pad 14 in the shell 10 ready for placement on a finger tip. The pad 14 may be easily removed with tweezers or a finger nail when the pad surface exposed to skin loses adherability due to contamination.

Figure 3:
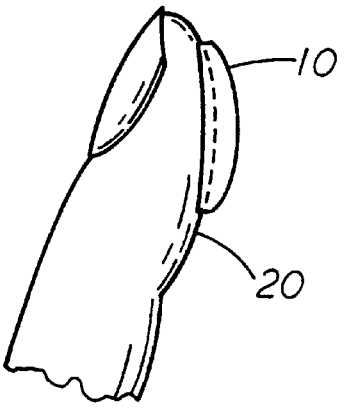
FIG. 3 illustrates the device in side view as positioned on a finger tip.

FIG. 3 illustrates application to the finger tip. The metal shell 10 configuration substantially conforms to the finger tip 20 and the finger tip skin and flesh conform to the device effectively creating a "metal skin" on the finger tip.

I claim:

1. A sewing and quilting finger tip protective device comprising a smooth convex thin hard shell with a periphery and having one side concave and sized to fit on the soft flesh portion of a finger tip, a pad sized to fit in the shell concave side, said pad not extending beyond the periphery of the shell and said pad having adhesive means applied to both sides thereof whereby one side of said pad is attached to the shell concave side and the other side of said pad is attachable to the soft flesh portion of the finger tip.

2. The sewing and quilting finger tip protective device of claim 1 wherein said shell is impermeable to needle penetration.

3. The sewing and quilting finger tip protective device of claim 1 wherein said shell is metallic.

4. The sewing and quilting finger tip protective device of claim 1 wherein said adhesive means is removable.

5. The sewing and quilting finger tip device of claim 1 wherein said shell is hard plastic.

6. The sewing and quilting finger tip device of claim 1 wherein said adhesive pad is replaceable with a fresh pad.

7. A sewing and quilting finger tip device comprising a smooth convex thin hard shell with a periphery and having one side concave and a disk shape and sized to fit on the soft flesh portion of a finger tip, and adhesive means applied to the shell concave side, said adhesive means not extending beyond the periphery of the thin hard said adhesive means adapted to attach the shell to the soft flesh portion of the finger tip.

8. The sewing and quilting finger tip device of claim 7 wherein said shell is impermeable to needle penetration.

9. The sewing and quilting finger tip protective device of claim 7 wherein said adhesive means is replaceable with fresh adhesive means.

10. The sewing and quilting finger tip protective device of claim 1 having a circular periphery.

* * * * *